United States Patent [19]

Seki et al.

[11] Patent Number: 5,045,651

[45] Date of Patent: Sep. 3, 1991

[54] SWITCH

[75] Inventors: Takahide Seki; Yasuharu Seki; Masanori Tsukushi; Syunji Itoh; Haruo Honda, all of Hitachi, Japan

[73] Assignee: Hitachi, Ltd., Tokyo, Japan

[21] Appl. No.: 470,584

[22] Filed: Jan. 26, 1990

[30] Foreign Application Priority Data

Feb. 8, 1989 [JP] Japan ..... 1-27659

[51] Int. Cl.[5] ..... H01H 33/82

[52] U.S. Cl. ..... 200/148; 200/148 R

[58] Field of Search ..... 200/148 A, 148 R

[56] References Cited

FOREIGN PATENT DOCUMENTS 57-69634 4/1982 Japan .
60-189129 9/1985 Japan .
62-16485 4/1987 Japan .

*Primary Examiner*—Robert S. Macon
*Attorney, Agent, or Firm*—Antonelli, Terry, Stout & Kraus

[57] ABSTRACT

A switch provided with a negative pressure chamber which is actuated in association with the separating operation of a movable contact. The negative pressure chamber is connected to a means for supplying a fluid to the negative pressure chamber so as to suppress the negative pressure in the negative pressure chamber during the initial stage of the separaating operation of the movable contact.

11 Claims, 6 Drawing Sheets

SWITCH

BACKGROUND OF THE INVENTION

The present invention relates to a switch and, more particularly, to a switch provided with a negative pressure generator for producing a gas-blast flow toward the arc.

A conventional switch of this type is composed of a sealed container charged with an arc extinguishing fluid such as $SF_6$ gas, a stationary contact and a movable contact provided in the container in such a manner as to be relatively separable from each other, a booster having a boosting chamber for boosting the arc extinguishing fluid by the energy of the arc produced by the separation of the contacts, and a negative pressure generator having a negative pressure chamber for producing a negative pressure by the relative movement of a cylinder and a piston induced by the separating operation of the contacts, as is disclosed in Japanese Patent Publication No. 16485/1987. To the arc between the separated contacts, a gas flow produced from the booster chamber toward the negative pressure chamber is blasted, thereby extinguishing the arc.

In a conventional switch provided with a booster and a negative pressure generator having the above-described structure, the negative generator is actuated from the initial stage of the cut-off operation, thereby producing a negative pressure. For this reason, the operating device of the switch must be so constructed as to produce a large operating force rapidly from the beginning of operation in correspondence with the negative pressure produced. This type of operating device, however, generally uses compressed air, so that it is difficult to obtain a large operating force at the initial stage of operation, as is known from the plenum characteristic thereof. On the other hand, use of an operating device of another system disadvantageously expands the size thereof.

SUMMARY OF THE INVENTION

Accordingly, it is an object of the present invention to eliminate the above-described problems in the prior art and to provide a switch which suppresses the rapid generation of a reaction force in a negative pressure chamber at the initial stage of operation so as to enable the miniaturization of an operating device.

To achieve this aim, the present invention provides a switch having a negative pressure chamber which is actuated in association with the separating operation of contacts, characterized in that the negative pressure chamber is connected to a means for supplying a fluid to the negative pressure chamber so as to suppress the negative pressure in the negative pressure chamber during the initial stage of the separation of the contacts.

A switch according to the present invention is capable of suppressing the generation of a negative pressure during the initial stage of the separation of the contacts, as described above. Therefore, the reacting force due to the generation of a negative pressure does not act on the operating device at the initial stage of the separating operation, and the operating device can be operated by a small operating force. After the end of the initial stage of the separating operation, it is possible to operate the operating device against the reaction force due to the generation of a negative pressure by the inertia force of the operating device obtained at the initial stage of the separating operation. It is therefore possible not only to miniaturize the operating device but also to adopt an operating device using compressed air.

The above and other objects, features and advantages of the present invention will become clear from the following description of the preferred embodiments thereof, taken in conjunction with the accompanying drawings.

DESCRIPTION OF THE PREFERRED EMBODIMENTS

Embodiments of the present invention will be explained hereinunder with reference to the accompanying drawings.

Figure 1:
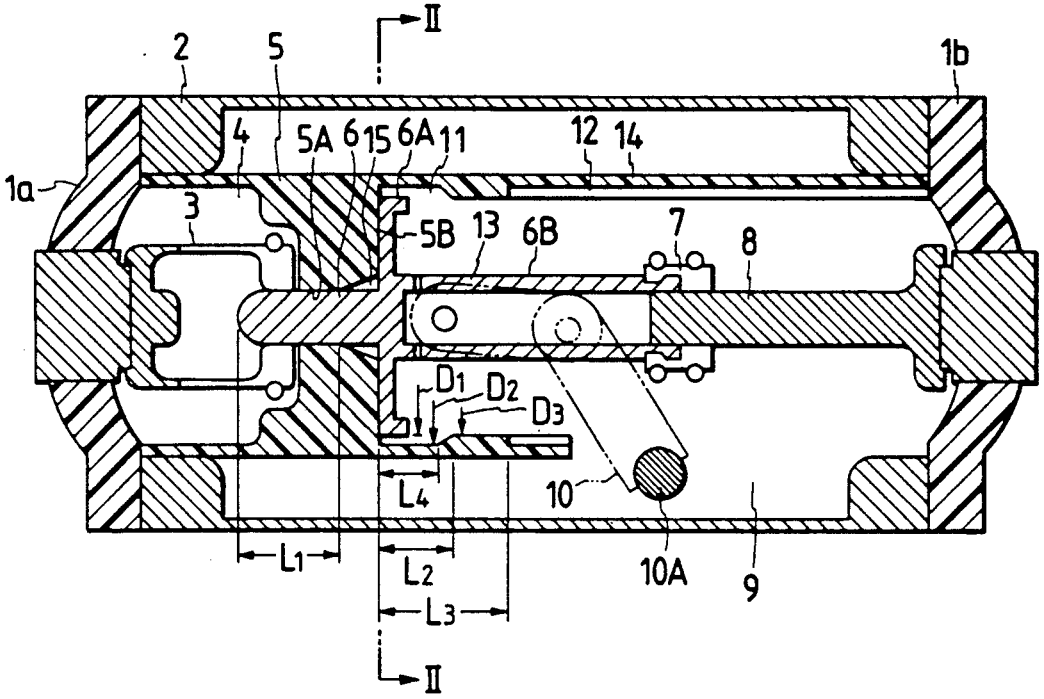
FIG. 1 is a sectional view of an embodiment of a switch according to the present invention.

FIG. 1 is a vertical sectional view of an embodiment of a switch according to the present invention in the closed state. In FIG. 1, both ends of a cylindrical breaker container 2 are sealed by insulating spacers 1*a*, 1*b*, respectively, thereby constituting a sealed container. The sealed container is charged with an arc distinguishing fluid such as an $SF_6$ gas. A stationary contact 3 is attached to the terminal at the central portion of the insulating spacer 1*a*. A movable contact 6 is brought into contact with the stationary contact 3 in such a manner as to face the stationary contact 3. A piston 6A and a center shaft 6B are integrally provided with the movable contact 6. The end portion of the center shaft 6B is slidably connected to a conductor 8 which is attached to the terminal of the insulating spacer 1*b* through a collector 7. To the center shaft 6B, a lever 10 connected to an operating device (not shown) is connected through a link 13. The lever 10 is connected to a center shaft 10A which is rotatably supported by the breaker container 2. Accordingly, when the center shaft 10A of the lever 10 is rotated clockwise, the movable contact 6 is operated through the link 13 so as to open the breaker, while the counterclockwise rotation of the center shaft 10A of the lever 10 operates the movable contact 6 so as to close the breaker.

Figure 2:
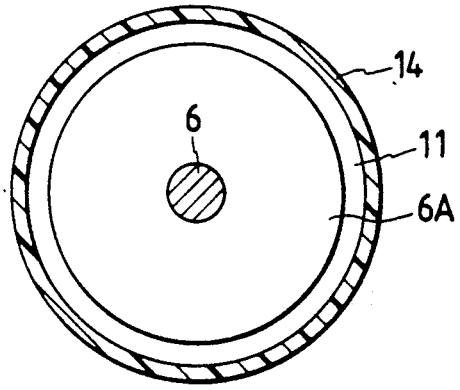
FIG. 2 is a sectional view of the embodiment shown in FIG. 1, taken along the line II—II.

To the interior of the breaker container 2 are fixed a cylindrical insulating nozzle 5 which encloses the stationary contact 3 and a cylinder 14 which encloses the center shaft 6B and the conductor 8. In the closed state shown in FIG. 1, the movable contact 6 is inserted into the throat portion 5A of the insulating nozzle 5 so as to come into contact with the stationary contact 3, and a booster chamber 4 including the contacting portion of the contacts 3, 6 is defined by the insulating nozzle 5 and the like. The insulating nozzle 5, the piston 6A and the cylinder 14 constitute a negative generator. The negative generator is provided with a negative pressure chamber 15 formed at the portion at which insulating nozzle 5 and the piston 6A faces each other. On the inside of the cylinder 14 on the side of the insulating nozzle 5, an annular first fluid passage 11 is formed, as shown in FIG. 2. In the closed state shown in FIG. 1, the negative pressure chamber 15 and the surrounding space 9 communicate with each other through a minute gap formed between the end surface 5B of the insulating nozzle 5 and the end surface of the piston 6A. The first fluid passage 11 is provided with an annular portion having a diameter $D_2$ which is larger than the inner diameter $D_3$ of the cylinder 14 and formed in the direction of the opening operation of the movable contact 6 extending over the distance of $L_4$ from the end surface 5B of the insulating nozzle 5. The inner wall of the cylinder 14 at the portion between the point distant from the end surface 5B of the insulating nozzle by $L_2$ and the point distant from the end surface 5B of the insulating nozzle 5 by $L_3$ has the inner diameter of $D_3$ which is substantially equal to the outer diameter $D_1$ of the piston 6A. On the inner wall of the cylinder 14 at the portion distant from the end surface 5B of the insulating nozzle 5 by not less than $L_3$, a second fluid passage 12 is formed. The distances $L_2$, $L_3$ and the distance $L_1$ by which the movable contact 6 is inserted into the throat portion 5A of the insulating nozzle 5 so as to fill the insulating nozzle 5 are set so as to satisfy the relationship $L_2<L_1<L_3$. Consequently, when the piston 6A moves in the direction of opening travel, the negative pressure chamber 15 first communicates with the surrounding space 9 through the first fluid passage 11, but when the piston 6A moves by the distance of $L_2$, the communication of the negative pressure chamber 15 with the surrounding space 9 is broken due to the contact between the outer peripheral surface of the piston 6A and the inner wall of the cylinder 14. When the piston 6A further moves to the point distant from the end surface of the cylinder 14 by the distance of $L_3$, the negative pressure chamber 15 communicates with the surrounding space 9 again through the second fluid passage 12.

Figure 3:
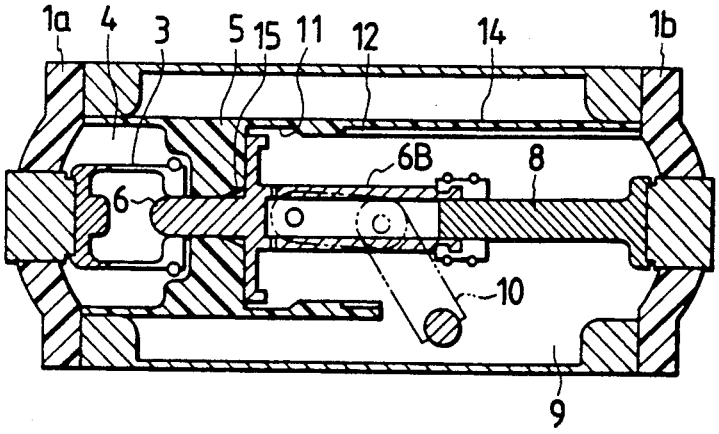
FIGS. 3 to 6 are sectional views of different operational states of the embodiment shown in FIG. 1.

The opening operation of the embodiment of a switch according to the present invention shown in FIG. 1 will now be explained with reference to FIGS. 3 to 6. FIG. 3 shows the switch in the closed state. At this time, the movable contact 6 is in contact with the stationary contact 3. The booster chamber 4 is partitioned from the surrounding space 9 because the movable contact 6 fills the insulating nozzle 5. The negative pressure chamber 15 communicates with the surrounding space 9 through the first fluid passage 11.

Figure 4:
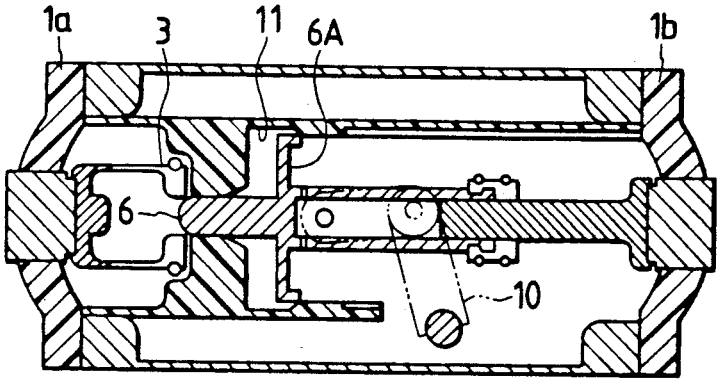

When the lever 10 is rotated clockwise by an operating device (not shown), the outer peripheral surface of the piston 6A closes the first fluid passage 11, as shown in FIG. 4, and a negative pressure is produced with the increase in the volume of the negative pressure chamber 15. Although the negative pressure acts on the opening operation of the movable contact 6 as a reaction force, the operating device (not shown) operates the piston 6A and the movable contact 6 so as to open the breaker against the reaction force by the inertia force obtained during the period from the closed state of the switch shown in FIG. 3 to the initial stage of the opening operation of the switch shown in FIG. 4. It is thus possible to reduce the influence of the reaction force of the negative pressure on the opening operation of the movable contact 6.

Figure 5:
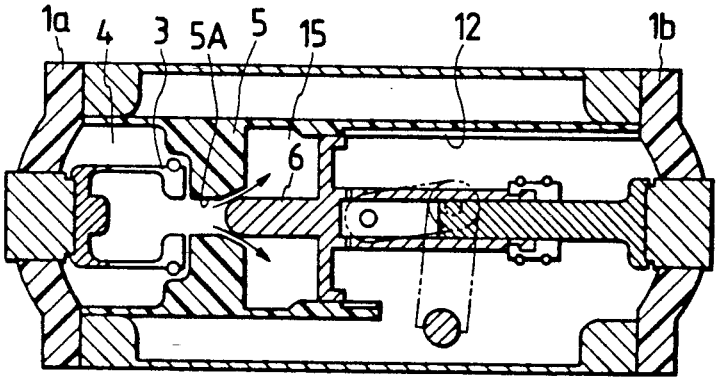

When the opening operation of the switch proceeds to a middle stage, as shown in FIG. 5, the movable contact 6 comes out of the throat portion 5A of the insulating nozzle 5. Consequently, the arc distinguishing fluid in the booster chamber 4 which is boosted by the energy of the arc generated by the separating operation between the stationary contact 3 and the movable contact 6 flows into the negative pressure chamber 15 in the pressure-reduced state through the throat portion 5A of the insulating nozzle 5. The fluid flow blasts the arc. In a current region in which the arc energy is comparatively small, the arc is distinguished in the state of the middle stage of the opening operation shown in FIG. 5. In the case where the arc energy is larger, however, the pressures of both chambers are balanced by the arc distinguishing fluid which flows from the booster chamber 4 to the negative pressure chamber 15, thereby obstructing effective blast to the arc. When the opening operation comes to the final stage shown in FIG. 6, the piston 6A reaches the- second fluid passage 12 and the negative pressure chamber 15 communicates with the surrounding space 9 through the second fluid passage 12. Therefore, the arc distinguishing fluid in the booster chamber 4 flows into the negative pressure chamber 15 and further into the surrounding space 9 through the second fluid passage 12. By this blast of the arc distinguishing fluid, the arc is distinguished.

Figure 7:
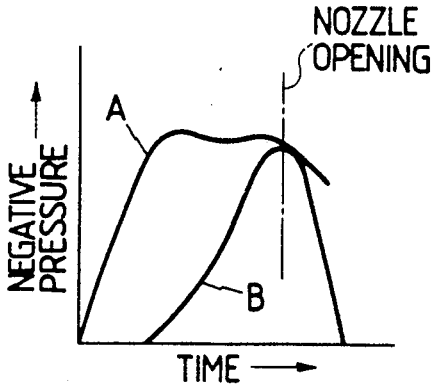
FIGS. 7 and 8 are pressure characteristic curves of the embodiment shown as compared with those of a conventional switch.

As is clear from the above explanation of the opening operation, the pressure characteristic of the negative pressure chamber 15 exhibits a pressure characteristic curve B which is slightly gentle in comparison with a conventional pressure characteristic curve A, as shown in FIG. 7. As a result, it is possible to reduce the size of an operating device for producing an output which resists the reaction force and to easily produce the operating device.

Figure 6:
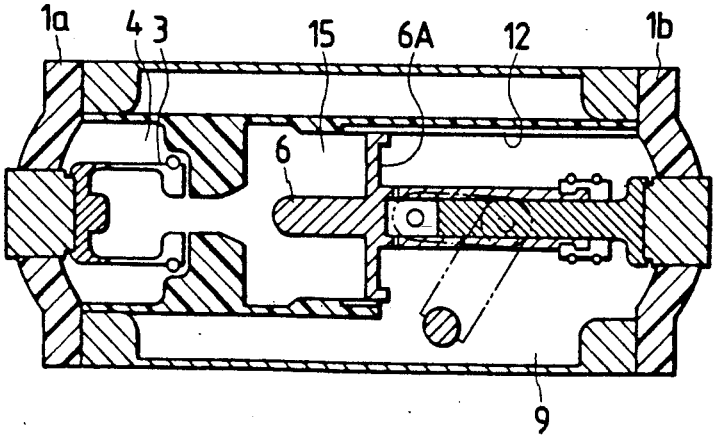
Figure 8:
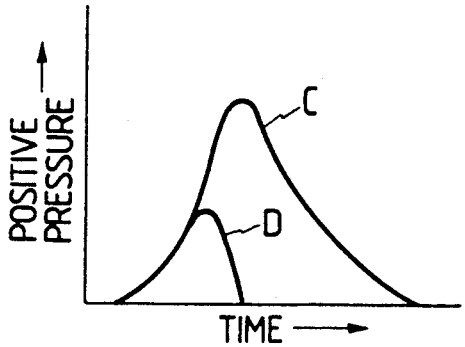

On the other hand, the closing operation is carried out in the reverse order of the above-described opening operation. When the lever 10 in the state shown in FIG. 6 is rotated counterclockwise, the communication between the negative pressure chamber 15 and the surrounding space 9 is broken in the state shown in FIG. 5, and the pressure of the negative pressure chamber 15 is raised. However, in the closing state after the state shown in FIG. 4, the negative pressure chamber 15 communicates with the surrounding space 9 through the first fluid passage 11 and the pressure of the negative pressure chamber 15 is released into the surrounding space 9 through the first fluid passage 11, so that the pressure characteristic of the negative pressure chamber 15 exhibits a pressure rise curve D which is lower than a pressure rise curve C of a conventional negative pressure chamber without the first fluid passage 11, as shown in FIG. 8. Thereafter, the switch assumes the closed state, as shown in FIG. 3. In the closing operation, since it is also possible to suppress the raise of the pressure of the negative pressure chamber 15, as shown in FIG. 8, it is possible to reduce the size of the operating device which executes the closing operation against the negative pressure.

Figure 9:
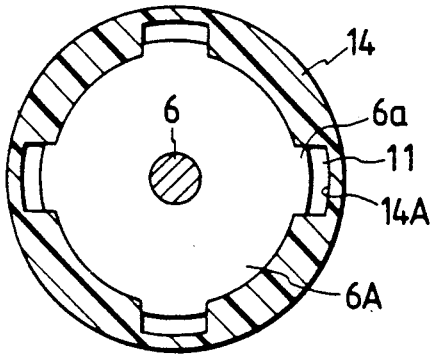
FIG. 9 is a sectional view of another example of the portion shown in FIG. 2.

In this embodiment, the first fluid passage 11 is formed by an annular groove having the inner diameter $D_2$ larger than the inner diameter $D_3$ of the cylinder 14. Another example of the first fluid passage 11 is shown in FIG. 9. A plurality of grooves 14A having the length equivalent to the distance $L_2$ from the end surface 5B of the insulating nozzle 5 are formed in the axial direction of the cylinder 14. Engaging portions 6*a* of the piston 6A are slidably engaged with the grooves 14A. The first fluid passage 11 is formed at the portions at which the grooves 14A and the engaging portions 6*a* face each other.

Figure 10:
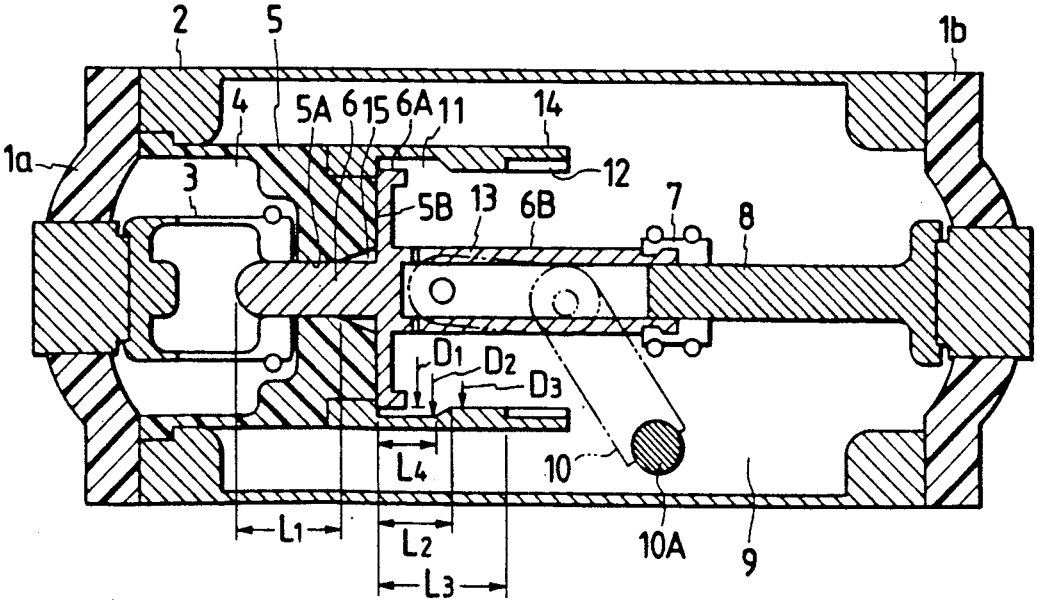
FIG. 10 is a sectional view of another embodiment of a switch according to the present invention.

FIG. 10 shows another embodiment of the present invention. In this embodiment, the insulating nozzle 5 is cantilevered on one side of the container 2, and the cylinder 14 made of a material different from that of the insulating nozzle 5 is provided on the insulating nozzle 5. This structure makes it possible to reduce the size and the weight of the cylinder 14. The operation and the advantages are the same as in the embodiment shown in FIG. 1. It is also possible in this embodiment to make the piston 6*a* from an insulating material different from that of the movable contact 6.

Figure 11:
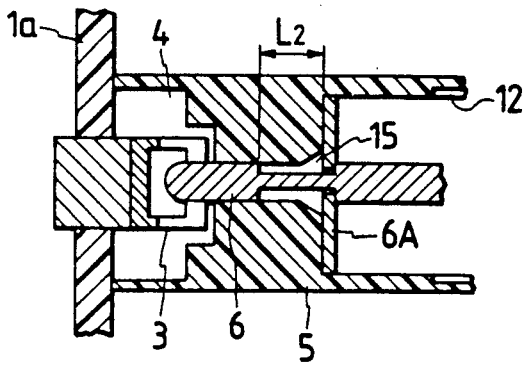
FIG. 11 is a sectional view of the main part of still another embodiment of a switch according to the present invention.

FIG. 11 is a sectional view of the main part of still another embodiment of the present invention. The same reference numerals denote the same or corresponding elements as or to those shown in FIG. 1.

This embodiment is different from the above-described embodiments in the structure for actuating the negative generator behind the opening operation of the movable contact 6 by a predetermined time. The movable contact 6 and the piston 6A are made separately from each other so as to be connected with each other after the movable contact 6 slides by the distance $L_2$, as shown in FIG. 11. Owing to this structure, the first fluid passage 11 is dispensed with. The second fluid passage 12 is the same as the second fluid passage 12 in the embodiment shown in FIG. 1.

Figure 12:
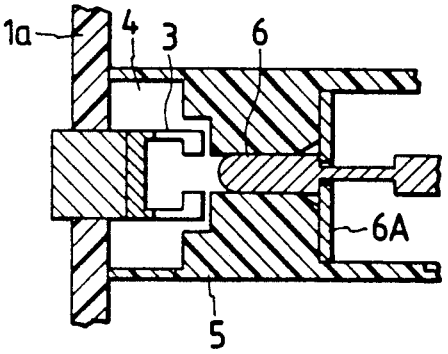
FIGS. 12 and 13 are sectional views of the main part of the embodiment shown in FIG. 11, showing the operational process thereof.
Figure 13:
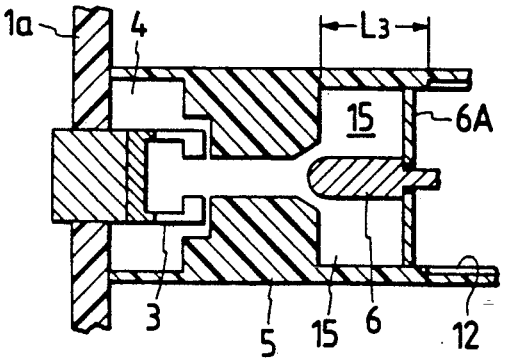

The operation of this embodiment will now be explained with reference to FIGS. 11 to 13.

In the closed state shown in FIG. 11, when the movable contact 6 is driven in the direction of opening travel, namely, to the right-hand side in FIG. 11, the movable contact 6 solely operates until the sliding distance reaches $L_2$. During this time, the piston 6A is held at the position shown in FIG. 11. The negative pressure generator therefore does not act and the volume of the negative pressure chamber 15 does not increase. However, when the opening operation of the movable contact 6 proceeds and the movable contact is separated from the stationary contact 3, the pressure of the booster chamber 6 rises due to the energy of the arc produced between both contacts 3, 6. When the movable contact 6 assumes the state shown in FIG. 12, the movable contact 6 is connected with the piston 6A in the direction of opening travel. Thereafter, the piston 6A is operated together with the movable contact 6 so as to operate the negative pressure generator, thereby increasing the volume of the negative pressure chamber 15, as shown in FIG. 13. When the movable contact 6 comes out of the throat portion 5*a* of the insulating nozzle 5, a fluid flow is formed until the booster chamber 4 and the negative pressure chamber 15 communicate with each other and the pressures thereof are balanced. The arc between the contacts 3, 6 is distinguished by the blasting operation of the fluid flow. The pressure of the negative chamber 15 gradually rises and when the movable contact 6 reaches the point distant from the end surface of the cylinder 14 by $L_3$ which is equivalent to the distance $L_3$ shown in FIG. 1, the negative pressure chamber 15 and the surrounding space 9 communicate with each other through the second fluid passage 12 in the same way as in the embodiment shown in FIG. 1.

This embodiment also enables the reaction force to the operating device at the initial stage of the separating operation to be reduced, thereby realizing a small-sized operating device like the above-described embodiments.

Figure 14:
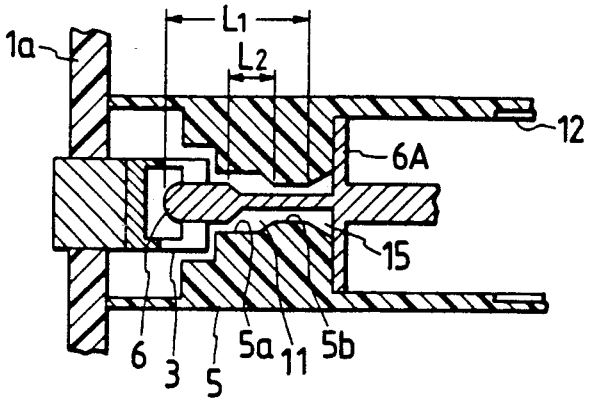
FIG. 14 is a sectional view of the main part of a further embodiment of a switch according to the present invention.

FIG. 14 is a sectional view of the main part of a further embodiment of the present invention. This embodiment is different from the above-described embodiments in the structure for actuating the negative generator behind the separating operation of the movable contact 6 by a predetermined time.

In this embodiment, a valve mechanism is provided at the engaging portion of the movable contact 6 and the insulating nozzle 5. As shown in FIG. 14, the valve mechanism is composed of a stepped portion provided at the center hall of the insulating nozzle 5, a large-diameter portion 5*a* for allowing the booster chamber 4 and the negative pressure chamber 15 to communicate with each other until the movable contact 6 moves by the distance $L_2$ to the left-hand side in FIG. 14, and a throat portion 5*b* for breaking the communication of both chambers 4, 15 during the period between the time when the the movable contact 6 has moved by the distance $L_2$ and the time when the movable contact 6 has moved by the distance $L_1$, which is equivalent to the distance $L_1$ in FIG. 1.

The operation of this embodiment will now be explained with reference to FIGS. 14 to 16.

Figure 15:
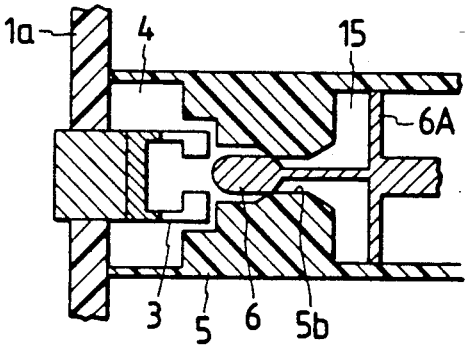
FIGS. 15 and 16 are sectional views of the main part of the embodiment shown in FIG. 14, showing the operational process thereof.
Figure 16:
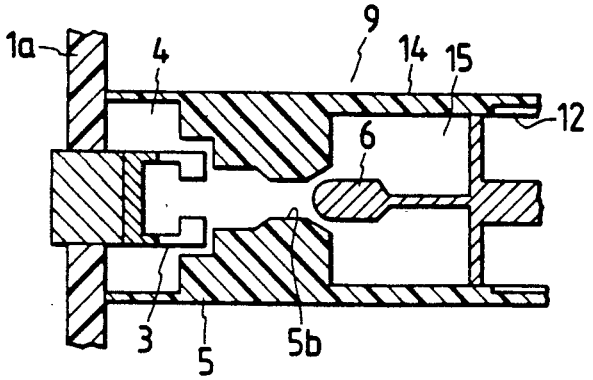

When the movable contact 6 is moved in the direction of separation in the closed stated shown in FIG. 14, since the booster chamber 4 and the negative pressure chamber 15 communicate with each other through the first fluid passage 11 formed by the large-diameter portion 5*a*, the negative pressure generator is not operated substantially and no negative pressure is produced in the negative pressure chamber 15 in spite of an increasing volume of the negative pressure chamber 15 until the breaker assumes the state shown in FIG. 15. However, when the breaker assumes the state shown in FIG. 15, since the movable contact 6 fills the throat portion 5*b*, the communication between the booster chamber 4 and the negative pressure chamber 15 is broken. The pressure of the booster chamber is therefore risen by the energy of the arc produced by the separation of the contacts 3, 6. In the negative pressure chamber 15 which is interrupted in communication with the booster chamber 5, a negative pressure is produced by the increase in the volume. When the opening operation proceeds to the state shown in FIG. 16, the movable contact 6 comes out of the throat portion 5*b*, whereby the booster chamber 4 and the negative pressure chamber 15 communicate with each other. As a result, the arc between the contacts 3, 6 is blasted by the flow of the arc distinguishing fluid and is distinguished. Thereafter, due to the movement of the movable contact 6, the negative pressure chamber 15 and the surrounding space 9 communicate with each other through the second fluid passage 12.

Since this embodiment is also so constructed as not to operate the negative pressure generator at the initial opening travel of the movable contact 6, it is possible to miniaturize and simplify the operating device and enhance the reliability in comparison with a conventional switch in which the negative pressure generator is activated from the start and produces a reaction force to the operating device.

Figure 17:
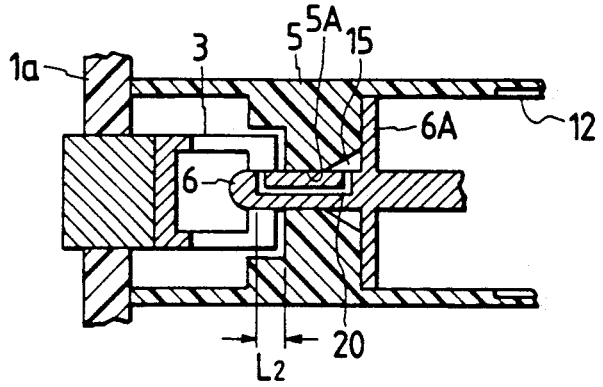
FIG. 17 shows the main part of a still further embodiment of a switch according to the present invention.

FIG. 17 is a sectional view of the main part of a still further embodiment of a switch according to the present invention. This embodiment is characterized in that a first fluid passage 20 is provided on the movable contact 6 so as to operate the negative pressure generator behind the opening operation of the movable contact 6 by a predetermined time.

In the closed state shown in FIG. 17, the first fluid passage 20 communicates with the booster chamber 4 on one end and with the negative pressure chamber 15 on the other end. The first fluid passage 20 is so designed that when the movable contact 6 travels the distance $L_2$ in the direction of opening operation, the end of the first fluid passage 20 on the side of the booster chamber 4 is closed by the insulating nozzle 5 so as to interrupt the communication between the booster chamber 4 and the negative pressure chamber 14. Therefore, although the piston 6*a* moves in the same direction with the opening operation of the movable contact 6 and increases the volume of the negative pressure chamber 15, since the booster chamber 4 and the negative pressure chamber 15 are in communication with each other by virtue of the first fluid passage 20, a negative pressure which acts on the operating device as a large reaction force is not produced in the negative pressure chamber 15, thereby substantially preventing the operation of the negative pressure generator. However, when the end of the first fluid passage 20 on the side of the booster chamber 4 is closed by the insulating nozzle 5, a negative pressure is produced in the negative pressure chamber 15 due to the increase of the volume of the negative pressure chamber 15. When the movable contact 6 comes out of the throat portion 5A of the insulating nozzle 5, a flow of the arc distinguishing fluid is formed from the booster chamber 4 toward the negative pressure chamber 15. The blast flow distinguishes the arc between the contacts 3, 6.

This embodiment also brings about the same advantages as the above-described embodiments.

Figure 18:
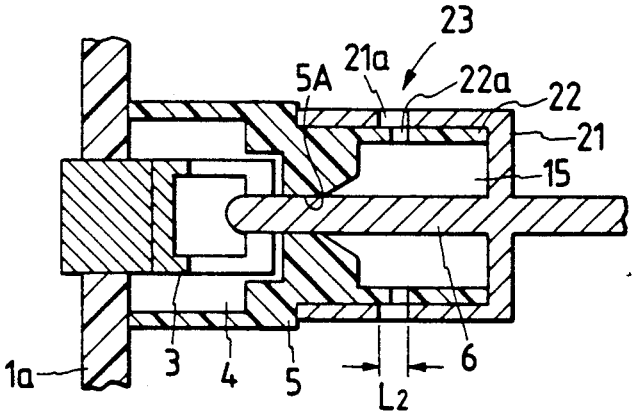
FIGS. 18 and 19 are sectional views of the main parts of still further embodiments of a switch according to the present invention, showing different operational states thereof.

FIG. 18 is a sectional view of the main part of a still further embodiment of a switch according to the present invention. In this embodiment, the operational relationship between the piston and the cylinder which constitute the negative pressure chamber 15 is reversed.

A cylinder 21 is provided on the movable contact 6. The cylinder 21 is slidably fitted over the outer periphery of a cylindrical portion 22 which is integrally provided with the insulating nozzle 5. The cylinder 21, the insulating nozzle 5, which also serves as a piston, and the cylindrical portion 22 constitutes the negative pressure chamber 15. On the side wall of the cylinder 21 and the cylindrical portion 22 of the insulating nozzle 5, a fluid passage 23 controlled by the movement of the cylinder 21 is formed. The fluid passage 23 is composed of a hole 22*a* formed at the cylindrical portion 22 and a hole 21*a* formed in the cylinder 21 such as to correspond to the hole 22*a* in the closed state shown in FIG. 18 and having a predetermined width in the direction of opening operation which allows the maintenance of communication with the hole 22*a* for a predetermined time.

Figure 19:
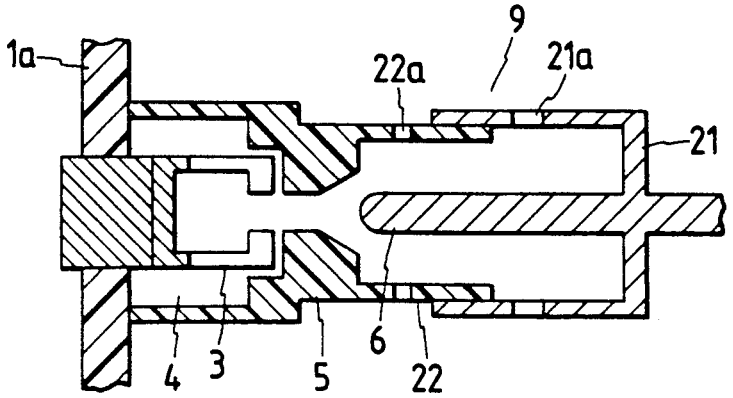

As a result, even if the movable contact 6 moves in the direction of operation, since the negative pressure chamber 15 communicates with the surrounding space 9 due to the communication between the holes 21*a* and 22*a* which constitute the fluid passage 23 for a predetermined time, the negative pressure substantially does not act on the negative pressure chamber 15. However, when the hole 21*a* passes the hole 22*a*, the communication between the negative pressure chamber 15 and the surrounding space 9 is broken, whereby the negative pressure chamber 15 produces a negative pressure. When the movable contact 6 comes out of the throat portion 5*b* of the insulating nozzle 5, a flow of the arc distinguishing fluid is formed from the booster chamber 4 toward the negative pressure chamber 15. The blast flow distinguishes the arc between the contacts 3, 6. Thereafter, the holes 21*a*, 22*a* which constitute the fluid passage 23 are released from each other, and the negative pressure chamber 15 communicates with the surrounding space 9, as shown in FIG. 19. This embodiment also brings about substantially the same advantages as the above-described embodiments.

Figure 20:
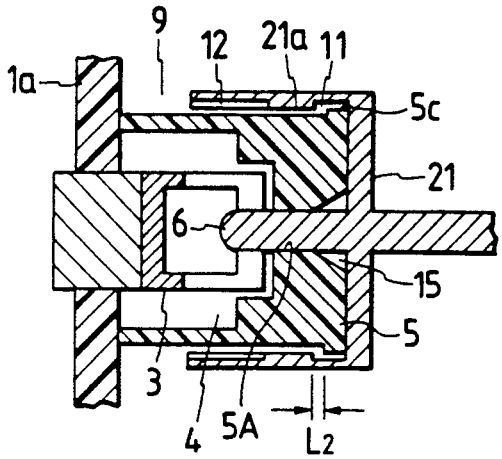
FIGS. 20 to 23 are sectional views of the main parts of still further embodiments of a switch according to the present invention.

FIG. 20 is a sectional view of the main part of a still further embodiment of a switch according to the present invention. In this embodiment, the cylinder 21 connected to the movable contact 6 is provided on the outer periphery of the insulating nozzle 5 in such a manner as to enclose the contacting portion of the contacts 3, 6. A large-diameter portion 5*c* is formed at the right-hand end portion of the insulating nozzle 5. The dimension of the large-diameter portion 5*c* substantially coincides with the dimension of a small-diameter portion 21*a* of the cylinder 21. On the inner wall of the cylinder 21 which corresponds to the large-diameter portion 5*c* in the closed state, the first fluid passage 11 is formed, and on the left-hand side of the small-diameter portion 21*a*, the second fluid passage 12 is formed.

Therefore, at the initial stage of the opening operation of the movable contact 6, although the volume of the negative pressure chamber 15 increases, since the negative pressure chamber 15 and the surrounding space 9 communicate with each other through the first fluid passage 11, no negative pressure which acts on the operating device as a large reaction force is not produced in the negative pressure chamber 15 unlike in the conventional switch. However, when the opening operation of the movable contact 6 is accelerated, the large-diameter portion 5*a* and the small diameter portion 21*a* fit each other, whereby the negative pressure chamber 15 is closed. The negative pressure chamber 15 thereafter produces a negative pressure. When the movable contact 6 comes out of the throat portion 5*b* of the insulating nozzle 5, a flow of the arc distinguishing fluid is formed from the booster chamber 4 toward the negative pressure chamber 15. The blast flow distinguishes the arc between the contacts 3, 6. Thereafter, since the second fluid passage 12 corresponds to the large-diameter portion 5*c*, the negative pressure chamber 15 communicates with the surrounding space 9.

According to this embodiment, it is possible not only to sufficiently reduce the volume of the negative pressure chamber 15 at the initial stage but also to miniaturize the operating device as in the above-described embodiments.

Figure 21:
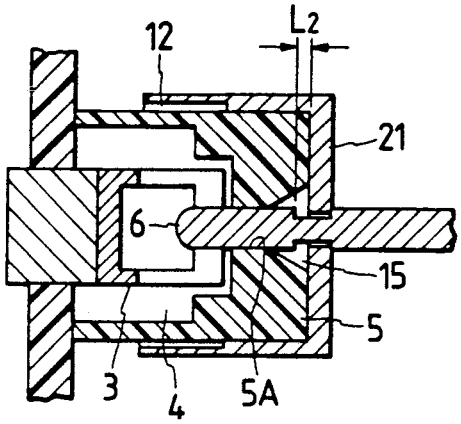
Figure 22:
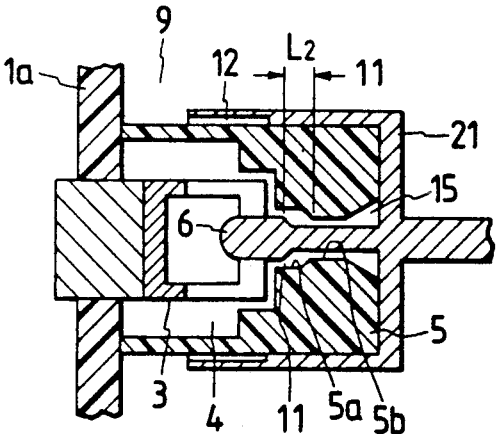
Figure 23:
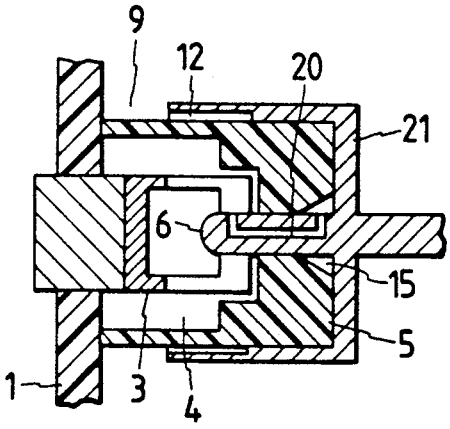

FIGS. 21 to 23 show still further embodiments of a switch according to the present invention. These embodiments are the same as those shown in FIGS. 11, 14 and 17, respectively, except that the piston 6A is fixed and the cylinder is made movable. The same numerals are provided for the elements which are the same as those in the above-described embodiments, and detailed explanation thereof will be omitted.

In any of these embodiments, the negative pressure generator is not actuated at the initial stage of the opening operation of the movable contact 6. After the movable contact 6 has travelled a predetermined distance, the communication between the booster chamber 4 and the negative pressure chamber 15 is broken, thereby actuating the negative pressure chamber pressure generator so as to produce a negative pressure. When the movable contact 6 comes out of the throat portion 5*b* of the insulating nozzle 5, a flow of the arc distinguishing fluid is formed from the booster chamber 4 toward the negative pressure chamber 15. The blast flow distinguishes the arc between the contacts 3, 6 in the same way as in the above-described embodiments. The raised pressure in the negative pressure chamber 15 is released when the second fluid passage 12 of the cylinder 21 reaches the right-hand end of the insulating nozzle 5 and thereby open the negative pressure chamber 15 into the surrounding space 9 through the second fluid passage 12.

According to these embodiments, it is also possible to simplify and miniaturize the operating device as in the above-described embodiments.

As described above, according to the present invention, since a negative pressure generator which is actuated behind the separating operation of the movable contact by a predetermined time is provided, it is possible to suppress a rapid reaction force in the negative pressure chamber at the initial stage of the opening operation, thereby reducing the size of the operating device.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A switch comprising:

a stationary cylindrical portion with one end thereof closed so as to form a booster chamber therewithin;

an insulating nozzle provided at the other end of said stationary cylindrical portion;

a first contact secured to the interior of said stationary cylindrical portion;

a second contact which can be brought into and out of contact with said first contact through the throat portion of said insulating nozzle;

a negative pressure chamber for generating a negative pressure by the separating operation of said second contact and sucking the fluid in said booster chamber; and a means for supplying said fluid to said negative pressure chamber so as to suppress the negative pressure in said negative pressure chamber during the initial stage of said separating operation of said second contact, said means being connected to said negative pressure chamber.

2. A switch according to claim 1, wherein said means for supplying said fluid to said negative pressure chamber includes a piston provided on said second contact, a cylinder provided on said insulating nozzle so as to slidably guide said piston, and a first fluid passage provided at the engaging portion of said piston and said cylinder in the closed state of said switch so that said negative pressure chamber communicates with the surrounding space in said stationary cylindrical portion through said first fluid passage during the initial stage of said separating operation of said second contact.

3. A switch according to claim 1, wherein said first fluid passage is an annular groove provided on the inner wall of said cylinder.

4. A switch according to claim 1, wherein said means for supplying said fluid to said negative pressure chamber includes a cylindrical portion provided on said insulating nozzle, a cylinder provided on said second contact so as to be slidably guided by said cylindrical portion, and a first fluid passage provided at the engaging portion of said cylindrical portion and said cylinder so that said negative pressure chamber communicates with the surrounding space in said stationary cylindrical portion through said first fluid passage during the initial stage of said separating operation of said second contact.

5. A switch according to claim 4, wherein said first fluid passage includes a first hole provided- in said cylindrical portion and a second hole provided in said cylinder in correspondence with said first hole.

6. A switch according to claim 1, wherein said means for supplying said fluid to said negative pressure chamber includes a first fluid passage which is provided at said throat portion of said insulating nozzle so that said negative pressure chamber communicates with said booster chamber through said first fluid passage during the initial stage of said separating operation of said second contact.

7. A switch according to claim 6, wherein said first fluid passage is an annular groove provided at said throat portion of said insulating nozzle.

8. A switch according to claim 1, wherein said means for supplying said fluid to said negative pressure chamber includes a first fluid passage provided at the portion of said second contact which is inserted into said throat portion of said insulating nozzle so that said negative pressure chamber communicates with said booster chamber through said first fluid passage during the initial stage of said separating operation of said second contact.

9. A switch according to claim 8, wherein said first fluid passage is a communication hole provided in said second contact.

10. A switch according to any of claims 2 to 9, wherein said negative pressure chamber is connected to a second fluid passage which allows said negative pressure chamber to communicate with the surrounding space in said stationary cylindrical portion at the final stage of said separating operation of said second contact.

11. A switch comprising:

a stationary cylindrical portion with one end thereof closed so as to form a booster chamber therewithin;

an insulating nozzle provided at the other end of said stationary cylindrical portion;

a first contact secured to the interior of said stationary cylindrical portion;

a second contact which can be brought into and out of contact with said first contact through the throat portion of said insulating nozzle;

a negative pressure chamber for generating a negative pressure by the separating operation of said second contact and sucking the fluid in said booster chamber; and a means for generating a negative pressure after the elapse of the initial stage of said separating operation of said second contact, said means being connected to said negative pressure chamber.

* * * * *